US007546646B2

(12) United States Patent
Shien

(10) Patent No.: US 7,546,646 B2
(45) Date of Patent: Jun. 16, 2009

(54) SHOWER HEAD THAT CAN SWIVEL FREELY

(75) Inventor: Ming-Dang Shien, Lu Kang (TW)

(73) Assignee: Horng Lai Industrial Co., Ltd., Changhua Hsien (TW)

( * ) Notice: Subject to any disclaimer, the term of this patent is extended or adjusted under 35 U.S.C. 154(b) by 690 days.

(21) Appl. No.: 11/183,619

(22) Filed: Jul. 18, 2005

(65) Prior Publication Data

US 2007/0011805 A1 Jan. 18, 2007

(51) Int. Cl.
*A47K 3/22* (2006.01)
*A47K 3/24* (2006.01)
*A47K 3/36* (2006.01)

(52) U.S. Cl. ..... 4/615; 4/567

(58) Field of Classification Search ..... 4/567, 4/570, 596, 615; 239/225.1–265
See application file for complete search history.

(56) References Cited

U.S. PATENT DOCUMENTS 3,724,760 A * 4/1973 Smith ..... 4/596
4,793,331 A * 12/1988 Stewart ..... 4/615
4,809,369 A * 3/1989 Bowden ..... 4/615
7,237,277 B1 * 7/2007 Tsai ..... 4/615
7,296,308 B2 * 11/2007 Turner ..... 4/507

* cited by examiner

*Primary Examiner*—Tuan N Nguyen
(74) *Attorney, Agent, or Firm*—Alan Kamrath; Kamrath & Associates PA

(57) ABSTRACT

A shower head includes a main body, a locking member, a water inlet tube, a water outlet tube, a water outlet sleeve, and a retaining cap. Thus, the water outlet sleeve is freely rotatable relative to the main body to adjust the water outlet directions of the shower head so as to satisfy the user's practical requirements. In addition, the water outlet sleeve has an upper end formed with an annular flange rested on the first O-ring of the water outlet tube and a lower end having a resting edge rested on the second O-ring of the water outlet tube to reduce the friction during rotation of the water outlet sleeve, so that the water outlet sleeve is rotatable easily and smoothly.

18 Claims, 5 Drawing Sheets

SHOWER HEAD THAT CAN SWIVEL FREELY

BACKGROUND OF THE INVENTION

1. Field of the Invention

The present invention relates to a shower head, and more particularly to a shower head that can freely swivel through 360 degrees.

2. Description of the Related Art

A conventional shower head in accordance with the prior art shown in FIGS. 6 and 7 comprises a main body 70 connected to a hose 80 having an enlarged end portion 81, a threaded sleeve 82 mounted on an end portion 71 of the main body 70 to attach the hose 80 to the main body 70, and a sealing gasket 83 mounted between the main body 70 and the end portion 81 of the hose 80. The end portion 71 of the main body 70 has an outer thread 711, and the threaded sleeve 82 has an inner thread 822 screwed onto the outer thread 711 of the main body 70. The threaded sleeve 82 has an inner wall formed with a resting edge 821 rested on the end portion 81 of the hose 80 to limit the end portion 81 of the hose 80 in the threaded sleeve 82. In such a manner, the main body 70 is rotatable relative to the hose 80 freely to adjust the water spraying direction of the main body 70.

However, the sealing gasket 83 located between the main body 70 and the end portion 81 of the hose 80 is made of rubber material, thereby increasing the friction between the main body 70 and the end portion 81 of the hose 80, so that the main body 70 cannot be rotated smoothly. In addition, when the main body 70 is placed on a wall seat, the user has to remove the main body 70 from the wall seat so as to rotate the main body 70 relative to the hose 80, thereby causing inconvenience to the user.

SUMMARY OF THE INVENTION

In accordance with the present invention, there is provided a shower head, comprising a main body, a locking member secured to a lower end of the main body for mounting a hose, a water inlet tube mounted in the main body and having a lower end connected to the locking member, a water outlet tube having a lower end connected to an upper end of the water inlet tube and having a periphery formed with a conduit connected to an inside of the water outlet tube, a water outlet sleeve rotatably mounted around the water outlet tube and having a periphery formed with a plurality of water outlet holes communicating with the conduit of the water outlet tube, and a retaining cap secured to an upper end of the water outlet tube and rested on the water outlet sleeve to prevent the water outlet sleeve from detaching from the water outlet tube.

The primary objective of the present invention is to provide a shower head that can freely swivel through 360 degrees.

Another objective of the present invention is to provide a shower head, wherein the water outlet sleeve is freely rotatable relative to the main body through 360 degrees to adjust the water outlet directions of the shower head so as to satisfy the user's practical requirements.

A further objective of the present invention is to provide a shower head, wherein the water outlet sleeve has an upper end formed with an annular flange rested on the first O-ring of the water outlet tube and a lower end having a resting edge rested on the second O-ring of the water outlet tube to reduce the friction during rotation of the water outlet sleeve, so that the water outlet sleeve is rotatable easily and smoothly, thereby facilitating a user operating the shower head.

A further objective of the present invention is to provide a shower head, wherein the user can directly rotate the water outlet sleeve to adjust the water spraying directions of the shower head without having to move the main body, thereby facilitating the user adjusting the water spraying directions of the shower head.

Further benefits and advantages of the present invention will become apparent after a careful reading of the detailed description with appropriate reference to the accompanying drawings.

DETAILED DESCRIPTION OF THE INVENTION

Figure 1:
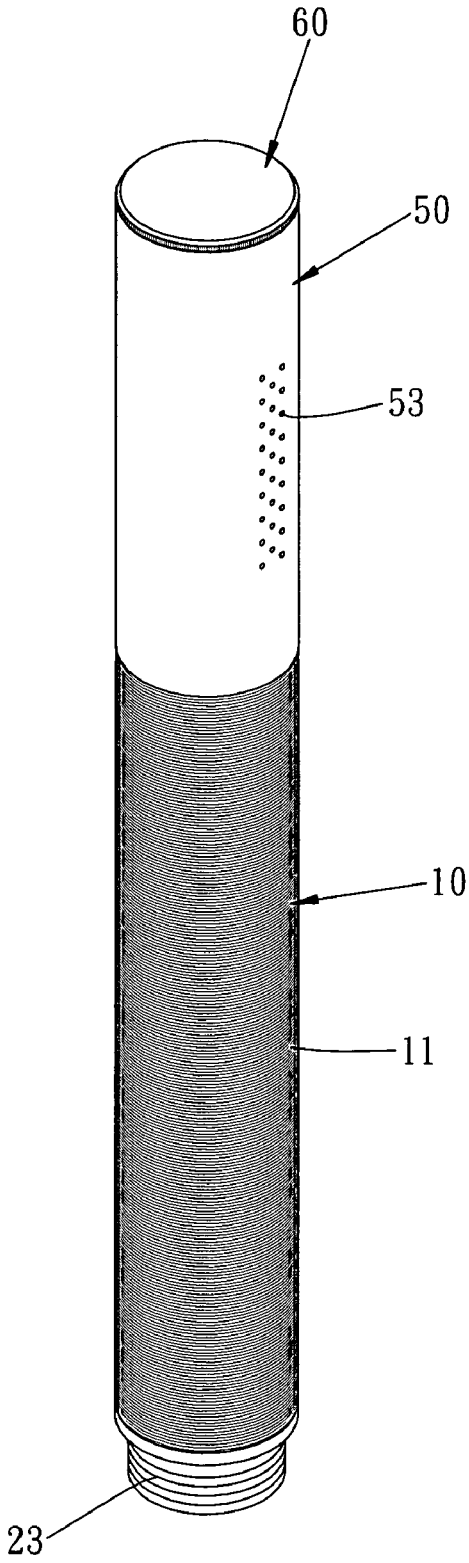
FIG. 1 is a perspective view of a shower head in accordance with the preferred embodiment of the present invention.
Figure 2:
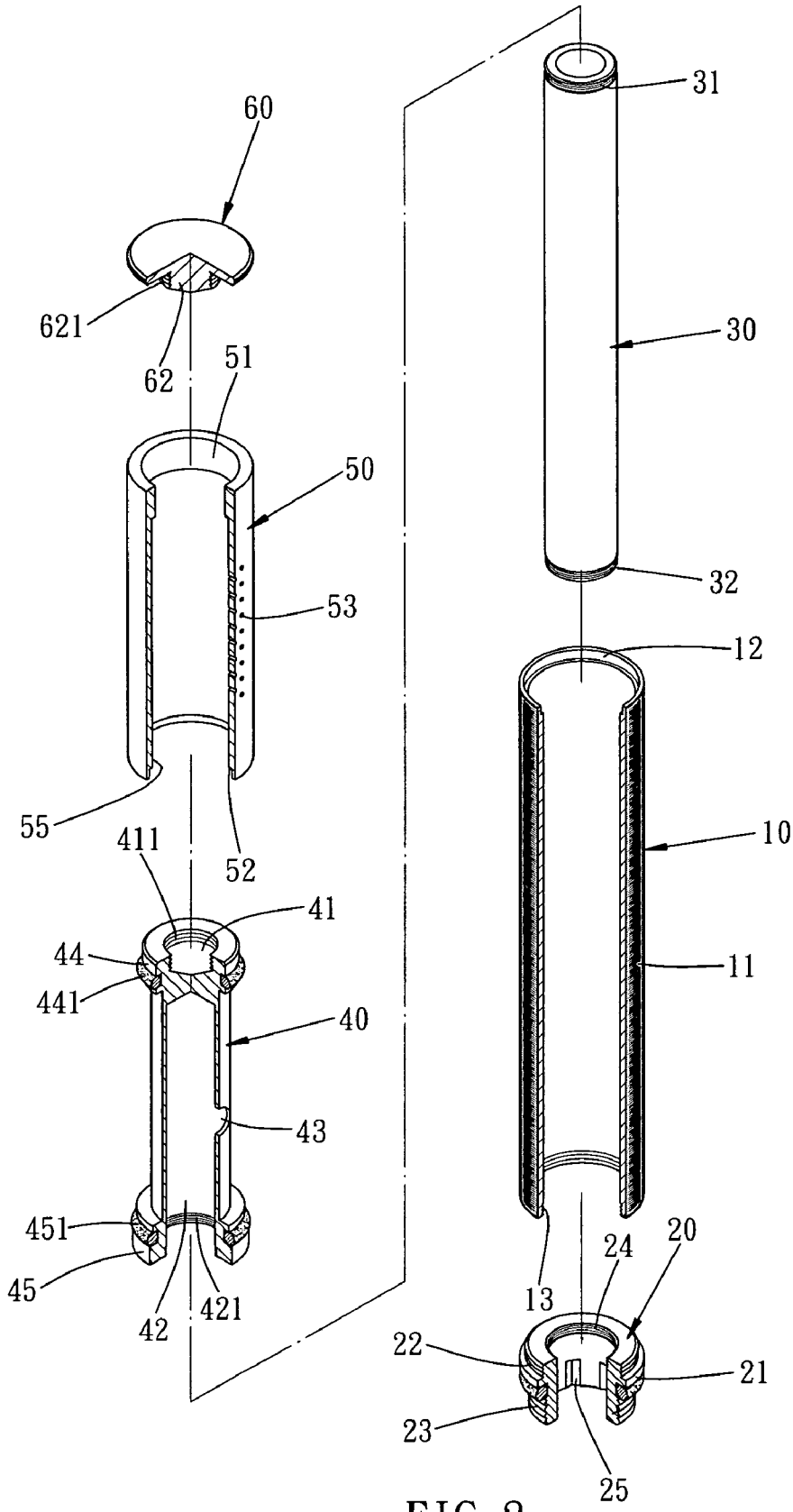
FIG. 2 is an exploded perspective view of the shower head as shown in FIG. 1.
Figure 3:
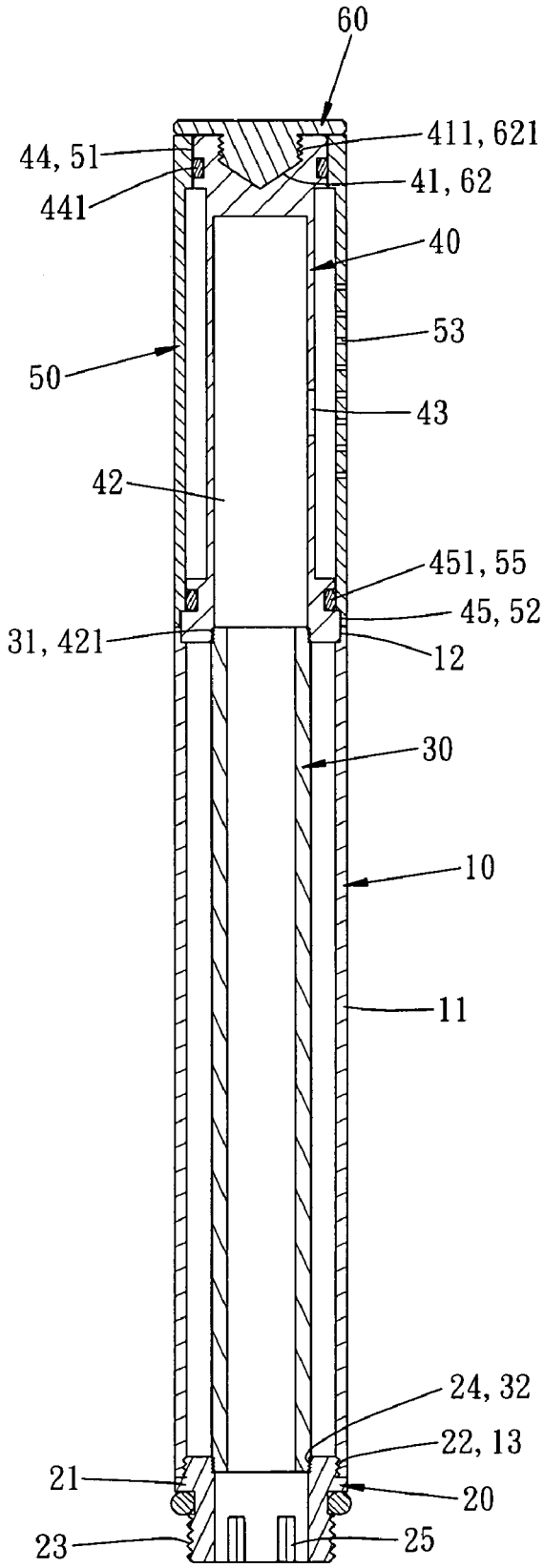
FIG. 3 is a plan cross-sectional view of the shower head as shown in FIG. 1.
Figure 4:
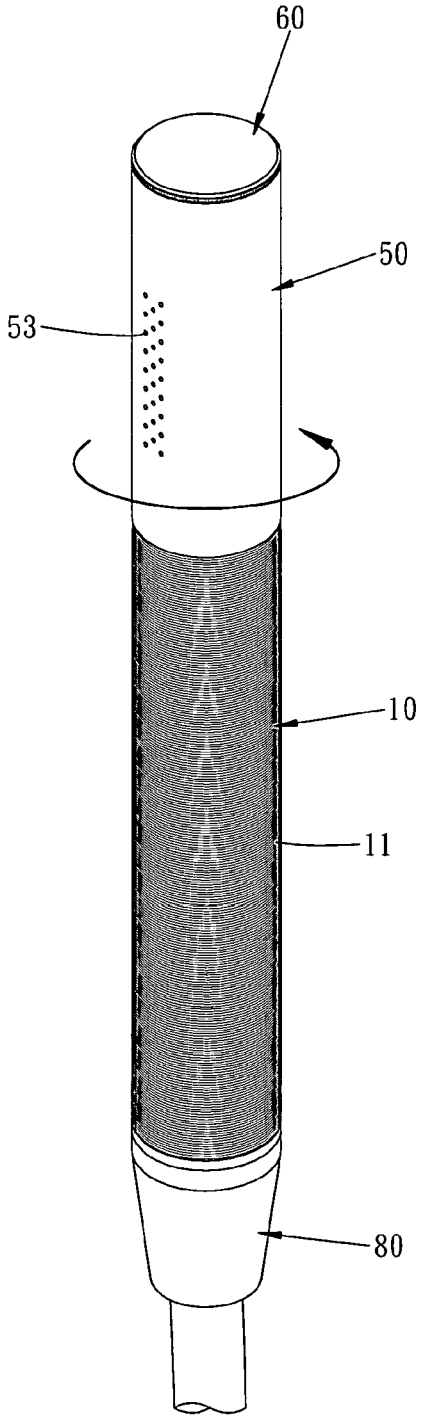
FIG. 4 is a schematic operational view of the shower head as shown in FIG. 1.

Referring to the drawings and initially to FIGS. 1-3, a shower head in accordance with the preferred embodiment of the present invention comprises a main body 10, a locking member 20 secured to a lower end of the main body 10 for mounting a hose 80 (see FIG. 4), a water inlet tube 30 mounted in the main body 10 and having a lower end connected to the locking member 20, a water outlet tube 40 having a lower end connected to an upper end of the water inlet tube 30 and having a periphery formed with a conduit 43 connected to an inside of the water outlet tube 40, a water outlet sleeve 50 rotatably mounted around the water outlet tube 40 and having a periphery formed with a plurality of water outlet holes 53 communicating with the conduit 43 of the water outlet tube 40, and a retaining cap 60 secured to an upper end of the water outlet tube 40 and rested on the water outlet sleeve 50 to prevent the water outlet sleeve 50 from detaching from the water outlet tube 40.

The main body 10 has a cylindrical shape. The main body 10 has an inner wall having an upper end formed with a stepped groove 12 and a lower end formed with an inner thread 13 and an outer wall formed with an anti-slip portion 11 to facilitate a user holding the main body 10.

Figure 5:
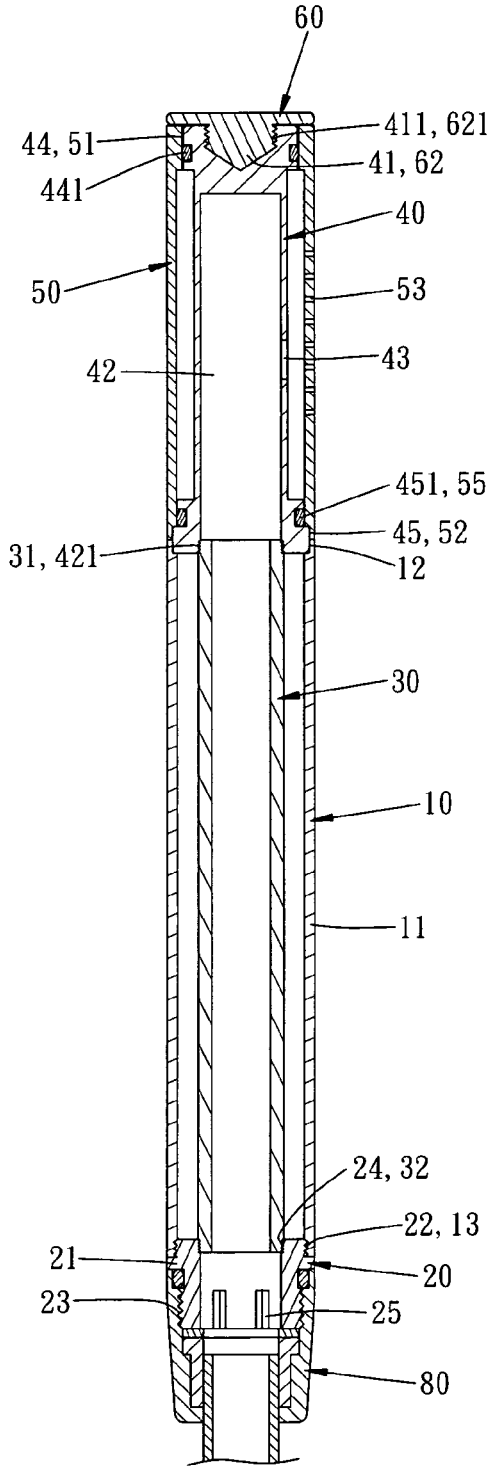
FIG. 5 is a schematic operational view of the shower head as shown in FIG. 3.
Figure 6:
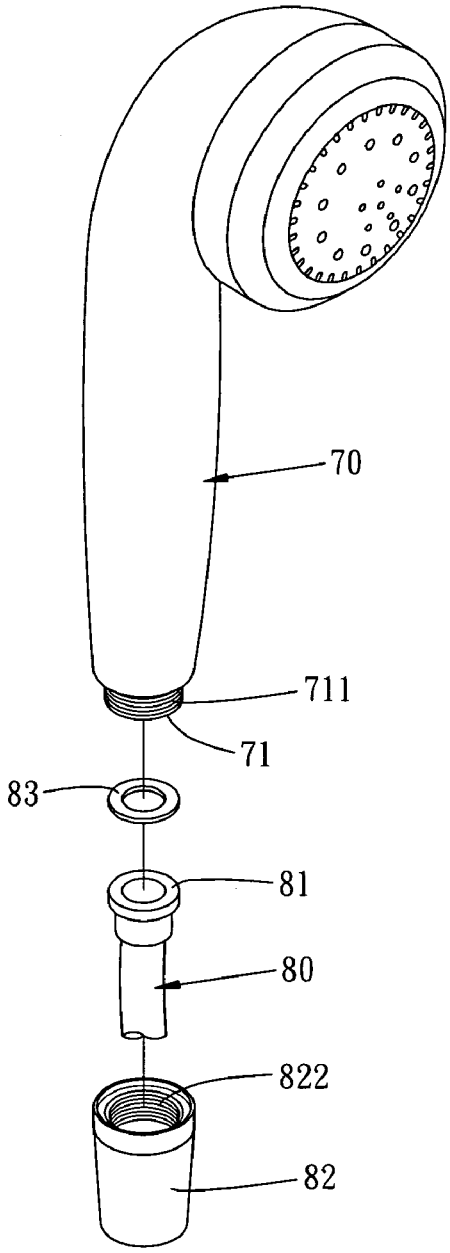
FIG. 6 PRIOR ART
FIG. 6 is an exploded perspective view of a conventional shower head in accordance with the prior art.
Figure 7:
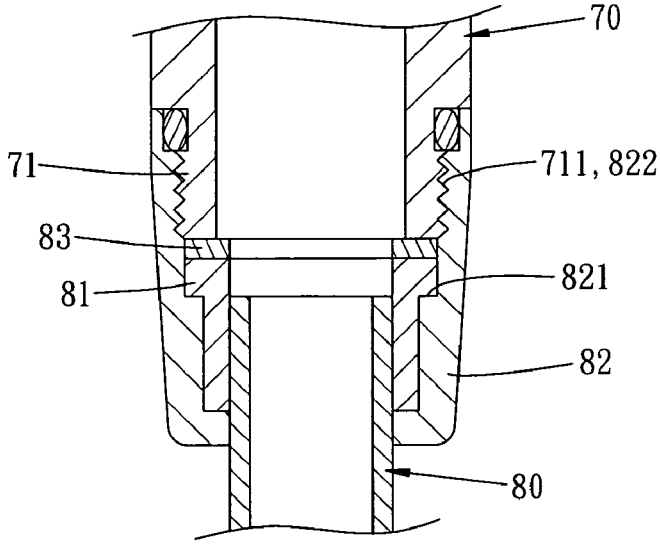
FIG. 7 PRIOR ART
FIG. 7 is a partially plan cross-sectional assembly view of the conventional shower head as shown in FIG. 6.

The locking member 20 has an outer wall having an upper end formed with an outer thread 22 screwed into the inner thread 13 of the main body 10, a mediate portion formed with a protruding ring 21 rested on the lower end of the main body 10 and a lower end formed with an outer thread 23 screwed into the hose 80 as shown in FIG. 5. The locking member 20 has an inner wall having an upper end formed with an inner thread 24 and a lower end formed with a hexagonal rotation portion 25 to allow insertion of a hexagonal tool (not shown) to rotate the locking-member 20.

The water inlet tube 30 has an outer wall having an upper end formed with an outer thread 31 and a lower end formed with an outer thread 32 screwed into the inner thread 24 of the locking member 20.

The water outlet tube 40 is protruded outward from the main body 10 and has a top face formed with a locking recess 41 having an inner thread 411. The inside of the water outlet tube 40 has a channel 42 communicating with the conduit 43 and the water inlet tube 30. The channel 42 of the water outlet tube 40 has a lower end formed with an inner thread 421 screwed onto the outer thread 31 of the water inlet tube 30. The water outlet tube 40 has an outer wall having an upper end formed with a first enlarged ring portion 44 provided with a first O-ring 441 rested on an inner wall of the water outlet sleeve 50 and a lower end formed with a second enlarged ring portion 45 provided with a second O-ring 451 rested on an inner wall of the water outlet sleeve 50.

The water outlet sleeve 50 is juxtaposed to and rotatably mounted on the main body 10. The inner wall of the water outlet sleeve 50 has an upper end formed with an annular flange 51 rested on the first O-ring 441 of the water outlet tube 40 and a lower end having a resting edge 55 rested on the second O-ring 451 of the water outlet tube 40 and having a mounting groove 52 for mounting the second enlarged ring portion 45 of the water outlet tube 40. The second enlarged ring portion 45 of the water outlet tube 40 is partially received in the stepped groove 12 of the main body 10.

The retaining cap 60 is a circular plate rested on the water outlet sleeve 50 and has a side formed with a locking post 62 inserted into the locking recess 41 of the water outlet tube 40. The locking post 62 of the retaining cap 60 has an outer thread 621 screwed into the inner thread 411 of the water outlet tube 40.

When in use, referring to FIGS. 1-5, the outer thread 23 of the locking member 20 is screwed into the hose 80 as shown in FIG. 5, so that the water from the hose 80 flows through the locking member 20, the water inlet tube 30, the channel 42 of the water outlet tube 40 and the conduit 43 of the water outlet tube 40 into the water outlet sleeve 50 and is injected outward from the water outlet holes 53 of the water outlet sleeve 50 for use with a user. In such a manner, the water outlet sleeve 50 is freely rotatable relative to the main body 10 through 360 degrees to adjust the water outlet directions of the shower head so as to satisfy the user's practical requirements.

Accordingly, the water outlet sleeve 50 is freely rotatable relative to the main body 10 through 360 degrees to adjust the water outlet directions of the shower head so as to satisfy the user's practical requirements. In addition, the water outlet sleeve 50 has an upper end formed with an annular flange 51 rested on the first O-ring 441 of the water outlet tube 40 and a lower end having a resting edge 55 rested on the second O-ring 451 of the water outlet tube 40 to reduce the friction during rotation of the water outlet sleeve 50, so that the water outlet sleeve 50 is rotatable easily and smoothly, thereby facilitating a user operating the shower head. Further, the user can directly rotate the water outlet sleeve 50 to adjust the water spraying directions of the shower head without having to move the main body 10, thereby facilitating the user adjusting the water spraying directions of the shower head.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shower head, comprising:

a main body;

a locking member secured to a lower end of the main body for mounting a hose;

a water inlet tube mounted in the main body and having a lower end connected to the locking member;

a water outlet tube having a lower end connected to an upper end of the water inlet tube and having a periphery formed with a conduit connected to an inside of the water outlet tube;

a water outlet sleeve rotatably mounted around the water outlet tube and having a periphery formed with a plurality of water outlet holes communicating with the conduit of the water outlet tube;

a retaining cap secured to an upper end of the water outlet tube and rested on the water outlet sleeve to prevent the water outlet sleeve from detaching from the water outlet tube;

wherein the water outlet tube has an outer wall having an upper end formed with a first enlarged ring portion provided with a first O-ring rested on an inner wall of the water outlet sleeve and a lower end formed with a second enlarged ring portion provided with a second O-ring rested on the inner wall of the water outlet sleeve;

the inner wall of the water outlet sleeve has an upper end formed with an annular flange rested on the first O-ring of the water outlet tube and a lower end having a resting edge rested on the second O-ring of the water outlet tube.

2. The shower head in accordance with claim 1, wherein the lower end of the inner wall of the water outlet sleeve has a stepped annular mounting groove for mounting the second enlarged ring portion of the water outlet tube.

3. The shower head in accordance with claim 2, wherein the main body has an inner wall having an upper end juxtaposed to the lower end of the inner wall of the water outlet sleeve and formed with a stepped groove, and the second enlarged ring portion of the water outlet tube is partially received in the stepped groove of the main body.

4. The shower head in accordance with claim 1, wherein the main body has an inner wall having a lower end formed with an inner thread, and the locking member partially protrudes outwardly from the lower end of the main body and has an outer wall having an upper end formed with an outer thread screwed into the inner thread of the main body.

5. The shower head in accordance with claim 1, wherein the main body has an outer wall formed with an anti-slip portion which extends through a whole length of the main body to facilitate a user holding the main body.

6. The shower head in accordance with claim 1, wherein the locking member partially protrudes outwardly from the lower end of the main body and has an outer wall having a mediate portion formed with a protruding ring rested on the lower end of the main body.

7. The shower head in accordance with claim 1, wherein the locking member has an outer wall having a lower end formed with an outer thread screwed into the hose.

8. The shower head in accordance with claim 1, wherein the locking member has an inner wall having a lower end formed with a hexagonal rotation portion to allow rotation of the locking member relative to the main body.

9. The shower head in accordance with claim 1, wherein the locking member has an inner wall having an upper end formed with an inner thread, and the water inlet tube has an outer wall having a lower end formed with an outer thread screwed into the inner thread of the locking member;

the lower end of the water inlet tube is secured to the locking member.

10. The shower head in accordance with claim 1, wherein the inside of the water outlet tube has a channel located between and communicating with the conduit and an inside of the water inlet tube.

11. The shower head in accordance with claim 10, wherein the water inlet tube has an outer wall having an upper end formed with an outer thread, and the channel of the water outlet tube has a lower end formed with an inner thread screwed onto the outer thread of the water inlet tube;

the lower end of the water outlet tube is secured to the upper end of the water inlet tube.

12. The shower head in accordance with claim 1, wherein the water outlet sleeve surrounds the water outlet tube;

the retaining cap is located outside of the water outlet sleeve and the water outlet tube;

the retaining cap has a periphery rested on an upper end of the water outlet sleeve;

the water outlet tube has a top face formed with a locking recess, and the retaining cap has a side formed with a locking post inserted into the locking recess of the water outlet tube.

13. The shower head in accordance with claim 12, wherein the locking recess of the water outlet tube has an inner thread, and the locking post of the retaining cap has an outer thread screwed into the inner thread of the water outlet tube;

the locking post of the retaining cap is secured in the locking recess of the water outlet tube.

14. The shower head in accordance with claim 1, wherein the retaining cap is a circular plate rested on the water outlet sleeve and has a diameter flush with that of the water outlet sleeve.

15. The shower head in accordance with claim 1, wherein the water outlet tube is located above the main body and the water inlet tube;

the water outlet tube is protruded outward from the main body and located in the water outlet sleeve.

16. The shower head in accordance with claim 15, wherein the water outlet sleeve is located above the main body and the water inlet tube;

the water outlet sleeve is juxtaposed to and rotatably mounted on the main body.

17. The shower head in accordance with claim 10, wherein water from the hose flows through the locking member, the water inlet tube, the channel of the water outlet tube and the conduit of the water outlet tube into an inside of the water outlet sleeve and is injected outward from the water outlet holes of the water outlet sleeve.

18. The shower head in accordance with claim 1, wherein the water outlet sleeve is freely rotatable relative to the main body through 360 degrees.

* * * * *